United States Patent [19]

Kimura

[11] Patent Number: 4,961,335

[45] Date of Patent: Oct. 9, 1990

[54] SMALL-DIAMETER METALLIC CONDUIT

[75] Inventor: Sadao Kimura, Numazu, Japan

[73] Assignee: Usui Kokusai Sangyo Kaisha Ltd., Nagasawa, Japan

[21] Appl. No.: 341,118

[22] Filed: Apr. 20, 1989

[30] Foreign Application Priority Data

Oct. 22, 1988 [JP] Japan ..... 63-266929
Dec. 15, 1988 [JP] Japan ..... 63-317428

[51] Int. Cl.[5] ..... B21D 7/024

[52] U.S. Cl. ..... 72/381; 72/306; 72/321; 72/388; 72/217

[58] Field of Search ..... 72/306, 319–321, 72/381, 384, 387, 388, 216–219, 403, 446, 386, 215

[56] References Cited

U.S. PATENT DOCUMENTS

| | | | |
|---|---|---|---|
| 183,190 | 10/1876 | McWilliams | 72/218 |
| 411,941 | 10/1889 | Taft | 72/218 |
| 641,535 | 1/1900 | McKibben | 72/388 |
| 2,366,012 | 12/1944 | Draper et al. | 72/217 |
| 2,964,085 | 12/1960 | Ghiringhelli | 72/306 |
| 3,420,279 | 1/1969 | Tuit | 72/320 |
| 4,249,407 | 2/1981 | Fogleman | 72/217 |
| 4,662,204 | 5/1987 | Saegusa | 72/306 |
| 4,735,075 | 4/1988 | Saegusa | 72/306 |
| 4,805,436 | 2/1989 | Saegusa | 72/306 |

FOREIGN PATENT DOCUMENTS

| | | | |
|---|---|---|---|
| 383620 | 10/1923 | Fed. Rep. of Germany | 72/219 |

*Primary Examiner*—Daniel C. Crane

*Attorney, Agent, or Firm*—Anthony J. Casella; Gerald E. Hespos

[57] ABSTRACT

A small-diameter metallic conduit bending machine includes a stationary frame which is shaped so as to substantially conform to a finished metallic conduit. A bending member is provided movably toward the stationary frame from thereoutside to bend a metallic conduit. To prevent the bending member from interfering with the metallic conduit which is moving as the result of the bending process of a preceding stage, an actuator is provided to remove the bending member from the moving area of the metallic conduit. That is, the binding member is made movable toward the stationary frame and retractable from the moving area of the metallic conduit.

12 Claims, 8 Drawing Sheets

SMALL-DIAMETER METALLIC CONDUIT

BACKGROUND OF THE INVENTION

1. Field of the Invention

This invention relates to a machine for bending a small-diameter metallic conduit at several points and more particularly, to a small-diameter metallic conduit bending machine adapted to shape a metallic conduit whose individual bend portions differ in the bend direction three-dimensionally from one another, not lying on the same plane, such as the fuel pipeline or brake pipeline of a car.

2. Description of the Prior Art

A conventional bending machine of the foregoing type includes a required number of bending units disposed correspondingly to a plurality of bend portions, each unit being configured as shown in FIG. 12 so that with respect to each bending process, a receiving roll 21 is moved by a cylinder 22 to come into contact with a metallic conduit 23, and then a bending roll 24 is moved by a cylinder 25 to bend the metallic conduit 23. In the drawing, 26 and 27 are mounts, 28 and 29 are stays, and 30 is a basement.

According to the foregoing conventional bending machine, however, since the bending process is carried out by moving the receiving roll 21 and the bending roll 24 by means of the respective cylinders 22 and 25, one bending process needs two actions; thus, the processing time is long. Since the bending process is completed when the piston rods of both cylinders 22 and 25 are in an extended state, upon supply of a pressurized fluid into the cylinder (generally, an air cylinder) at the time of bending, the bending moment imposed on the piston rod increases, and flexure resulting from the reaction caused at the time of bending appears in the stays 28 and 29 and mounts 26 and 27 for supporting the cylinders 22 and 25; as a result, a minute discrepancy (called "breathing" by those skilled in the art) appears between the receiving roll 21 and the bending roll 24, thereby resulting in variations in products. To eliminate such a discrepancy, it is necessary to make the stays 28 and 29 and the mounts 26 and 27 thick and rigid; consequently, the machine becomes large in size and heavy (but, in spite of such provisions, some discrepancy cannot be eliminated). Further, since the whole machine is designed and composed while giving consideration to the position, orientation, etc. of each of the cylinders 22 and 25, receiving roll 21 and bending roll 24, a long time is needed for manufacture, such as assembly and adjustment; as a result, the machine cannot be put in service in time where the start of mass production is settled. In addition, since the number of parts and of moving portions is large, the manufacturing cost is very high and the durability is inferior.

Especially, where one bending mechanism and a subsequent bending mechanism are to be disposed close to each other, the two mechanisms cannot be disposed or must be mounted using a complicated mechanism because they would interfere with each other even partly. Further, when the metallic conduit is brandished during bending, it under movement tends to interfere with the bending member.

SUMMARY OF THE INVENTION

Therefore, it is the object of the present invention to provide a bending machine capable of preventing the occurrence of interference of a metallic conduit with a bending member when the metallic conduit is brandished during bending to reach a next given position, preventing the appearance of a discrepancy (breathing), completing one bending process through one action to shorten the processing time, and making it easy to take out the the metallic conduit completely bent and shaped, which is small in size, light in weight, low in cost, and easy to manufacture.

To achieve the foregoing object, a small-diameter metallic conduit bending machine according to the present invention comprises a stationary frame which is formed by connecting bar stock or pipe stock into a shape substantially conforming to the finished curved shape of a metallic conduit over the whole length; at least one of two, first and second bending sections provided in the stationary frame, the first bending section including a first guide surface defined by a surface which has a curvature smaller than the bend radius of the metallic conduit in the lengthwise direction and is substantially orthogonal to the bend plane of the metallic conduit in the widthwise direction, and the second bending section including a second guide surface which is defined by a surface substantially parallel to the bend plane and a guide member which is mounted to the stationary frame in a direction substantially orthogonal to the second guide surface and has a curvature smaller than the bend radius of the metallic conduit; a bending member which is moved by an actuator attached via a bracket to the stationary frame toward the stationary frame from thereoutside so that the metallic conduit can be bent so as to lie along the first guide surface in the first bending section or along the second guide surface and the guide member in the second bending section; and means for removing the bending member from the moving area of the metallic conduit when the bending member is to interfere with the metallic conduit which is moving as the result of the bending process of a preceding stage.

As will be appreciated from the foregoing, the present invention performs bending by the use of the stationary frame with the guide surface and the bending member which is moved from outside the guide by the actuator, such as air cylinder or rotary actuator, attached to the frame via the bracket so that the metallic conduit can be bent so as to lie along the guide surface or along the guide surface and the guide member. Therefore, since the actuator for moving the bending member is coupled to the stationary frame by welding or the like, flexure is prevented from appearing in a stay or the like. Since the bending process is carried out preferably when the piston rod of the air cylinder is in a pulling stroke not in a pushing stroke (in an extended state), in contrast to the prior art, no appreciable bending moment is imposed on the piston rod or the like at the termination of each bending process, so that the influence of looseness of a bush provided for the piston rod becomes minimum; thus, any minute discrepancy (breathing) in relation to the bending member can be prevented from appearing.

Further, to avoid the situation wherein the metallic conduit, which is moving or being brandished as the result of the bending process of a preceding stage, interferes with the bending member, or wherein the bending member lies on the bend plane of the preceding stage, the actuator for moving the bending member is rotated a certain angle via a bracket to prevent the bending member from interfering, or the bending member is previously retracted by a cylinder attached to the distal end of the actuator spaced a certain distance from the bend plane of the frame via the bracket to prevent the bending member from interfering. When bending the metallic conduit, the bending member is projected to the bend plane to perform bending, and after the completion of bending of the metallic conduit, the bending member is returned to its retracted position. Thus, the metallic conduit completed through all bending processes can be readily taken out. In addition, since the frame is readily formed by welding or the like and then the bending member (inclusive of the actuator) is disposed so as to face the frame, the machine can be made small in size and light in weight.

DETAILED DESCRIPTION OF THE PREFERRED EMBODIMENTS

Figure 1:
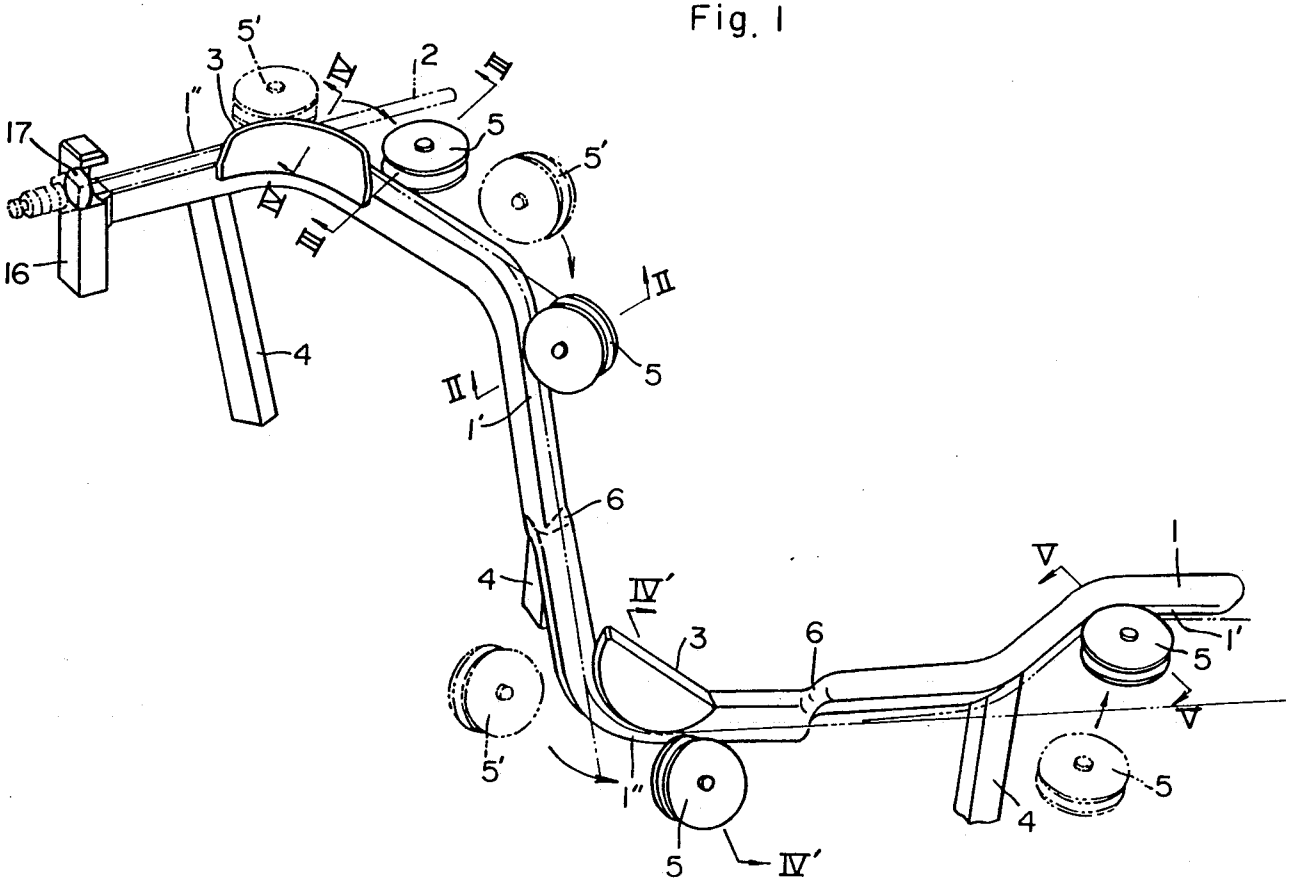
FIG. 1 is a schematic perspective view showing a stationary frame used in the present invention.
Figure 2:
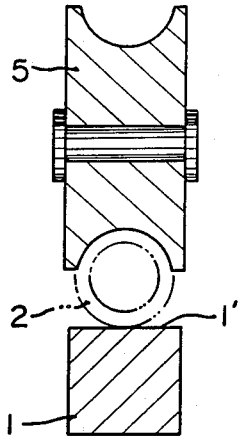
FIG. 2 is an enlarged sectional view taken along line II—II of FIG. 1.
Figure 3:
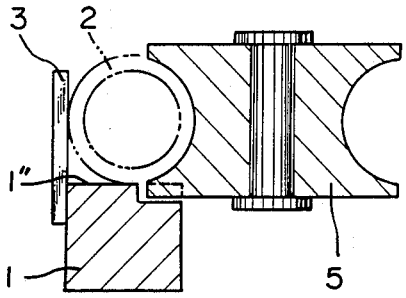
FIG. 3 is an enlarged sectional view taken along line III—III of FIG. 1.
Figure 4A:
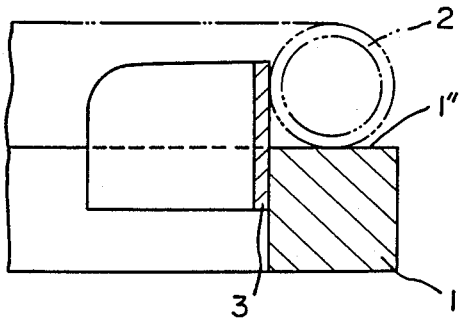
FIGS. 4(*a*) and 4(*b*) are enlarged sectional views taken along line IV—IV and line IV'—IV', respectively, of FIG. 1.
Figure 4B:
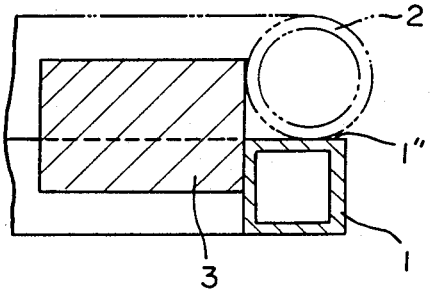
Figure 5:
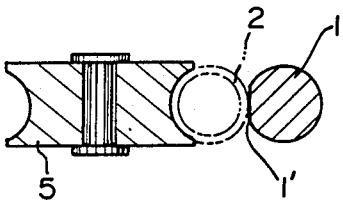
FIG. 5 is an enlarged sectional view taken along line V—V of FIG. 1.

In FIGS. 1 through 5, reference numeral 1 designates an elongate stationary frame made of bar stock, pipe stock (FIG. 4(*b*)), or the like in continuous form by welding 9, which substantially conforms in curved shape to a metallic conduit 2 over the whole length and has, in the vicinity of a bending member 5, preferably within the range of bend angle, a first guide surface 1' defined by a surface whose widthwise direction is substantially orthogonal to a bend plane and a second guide surface 1" defined by a surface whose widthwise direction is substantially parallel to the bend plane. The sectional contour of the frame includes a flat portion and preferably is made substantially quadrangular. However, the sectional shape of the second guide surface 1" is not necessarily limited to the above, but may take a circular shape; in this latter case, the second guide surface 1" means a surface which extends in a direction substantially orthogonal to a guide member 3 hereinafter described and is formed by lines tangential to the outer peripheral surface of the metallic conduit 2. At a given position in relation to the frame 1 effective in bending the metallic conduit 2, there is disposed a guide member 3 which has a curvature smaller than the bend radius of the metallic conduit 2 and is secured by welding or the like in a direction substantially orthogonal to both the first guide surface 1' and the second guide surface 1". The curvature and shape of each of the first guide surface 1', second guide surface 1", guide member 3, frame 1, etc. are determined in consideration of the spring back of the metallic conduit 2 occurring at the time of bending. Here, the guide member 3 may be shaped like a plate piece as shown in FIG. 4(*a*) or like a block as shown in FIG. 4(*b*). Although the frame 1 illustrated is secured on a base (not shown) by means of a required number of posts 4, according to the present invention, the base is not necessarily required if the posts 4 are connected together, in contrast to the prior art. A bending member 5 is disposed as being able to move toward the stationary frame 1 while pressing the metallic conduit 2 so as to lie along the first guide surface 1' or along the second guide surface 1" and the guide member 3. In FIG. 2, the bending member 5 for performing bending in cooperation with the first guide surface 1' is disposed so that its outer peripheral surface faces the first guide surface 1'. In FIG. 3, the bending member 5 for performing bending in cooperation with the second guide surface 1" and the guide member 3 is disposed so that its moving direction is substantially parallel to the second guide surface 1" or intersects therewith with a slight inclination. The numeral 5' designates the bending member before the bending process in FIG. 1.

Figure 7A:
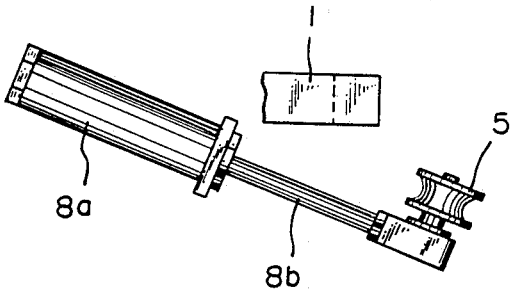
FIGS. 7(A) to 7(F) are front views explanatory of the operation of the embodiment shown in FIG. 6.
Figure 7D:
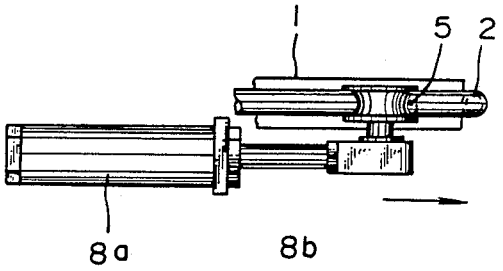
Figure 7B:
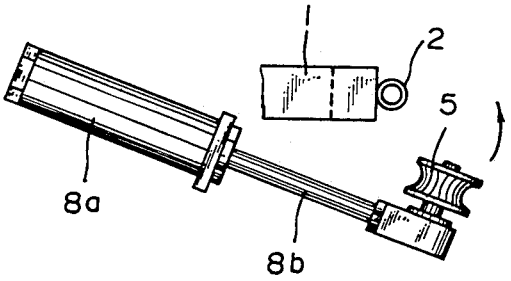
Figure 7E:
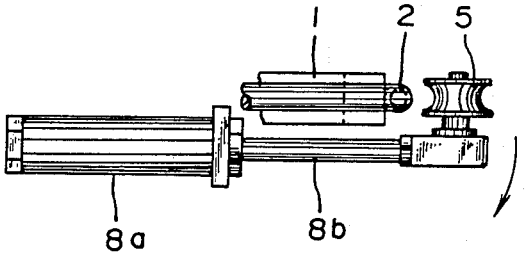
Figure 7C:
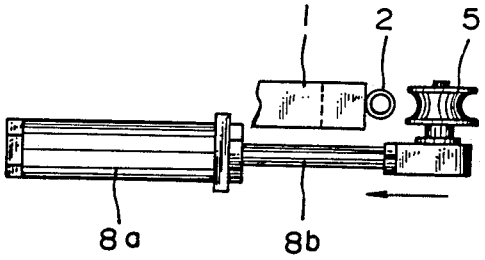
Figure 7F:
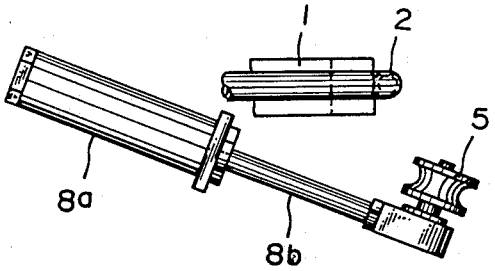
Figure 8:
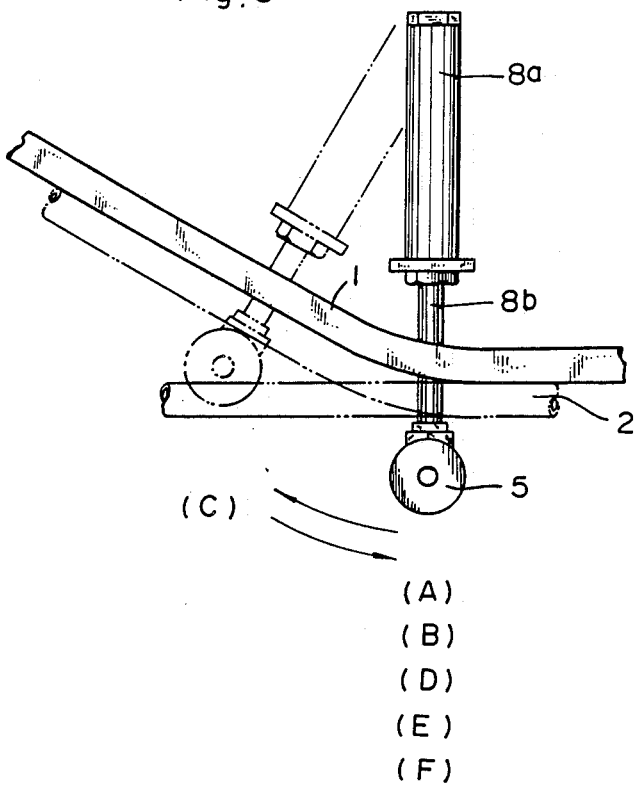
FIG. 8 is a plan view corresponding to FIG. 7.
Figure 11:
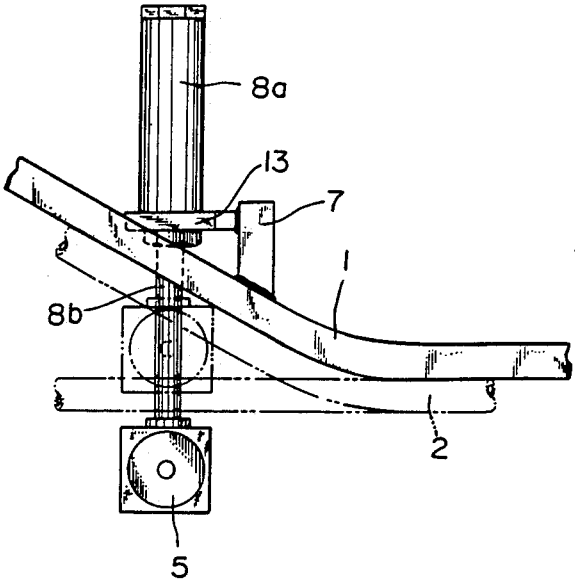
FIG. 11 is a plan view corresponding to FIG. 10.
Figure 9:
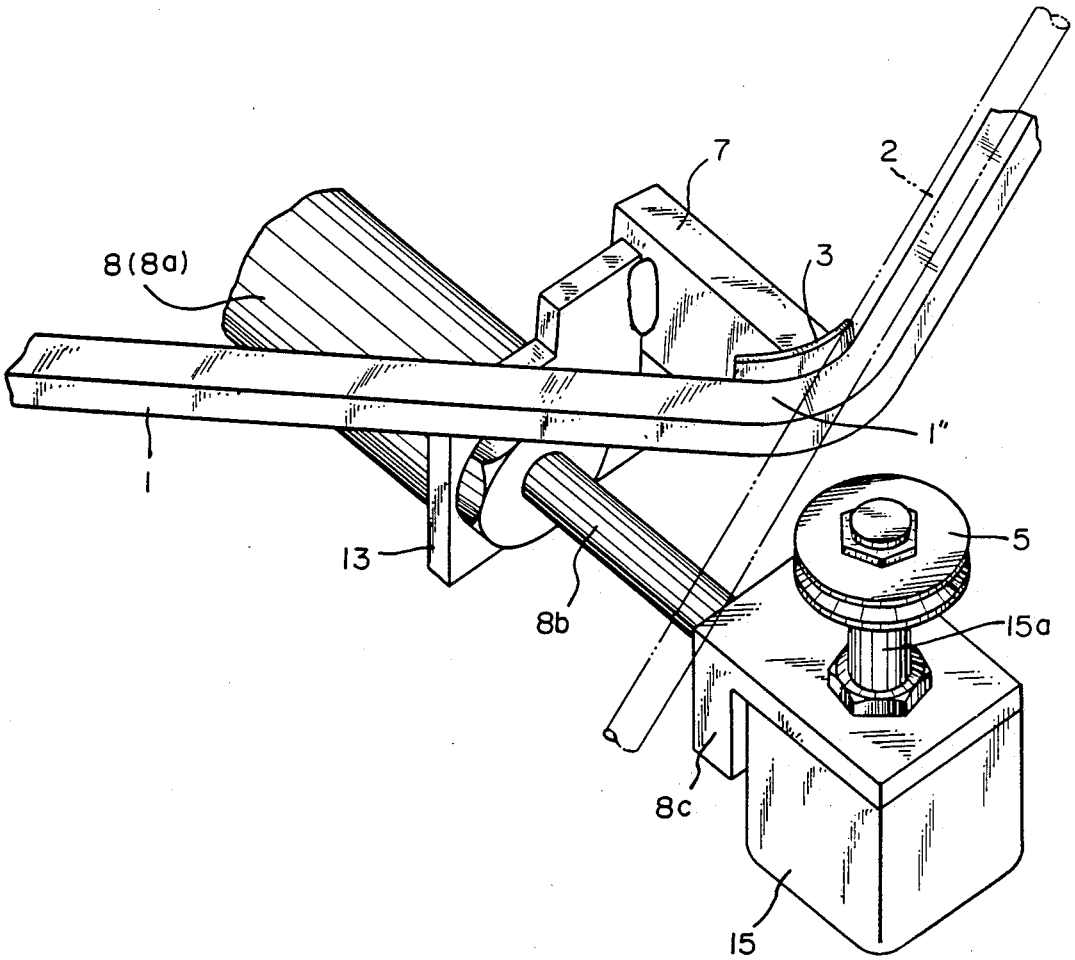
FIG. 9 is a fragmentary perspective view showing another embodiment of the present invention.

The bending member 5 is attached to a lever 9 of L shape, for example, which is moved by an actuator (a cylinder 8*a*, in the embodiment) 8 attached via a bracket to the frame 1 (FIGS. 6 to 8), or is attached via an angle piece 8*c* to the point of a piston rod 8*b* of the actuator 8 (FIGS. 9 to 11). Of course, the embodiment of FIGS. 9 through 11 may use a lever for attachment.

According to the prior art, as described above, the metallic conduit 2 sometimes interferes with the bending member of a succeeding stage while the metallic conduit 2 is moving (is being brandished) as the result of the bending process of a preceding stage. The present invention avoids the interference of the metallic conduit with the bending member 5 by configuring the embodiments as below.

Figure 6:
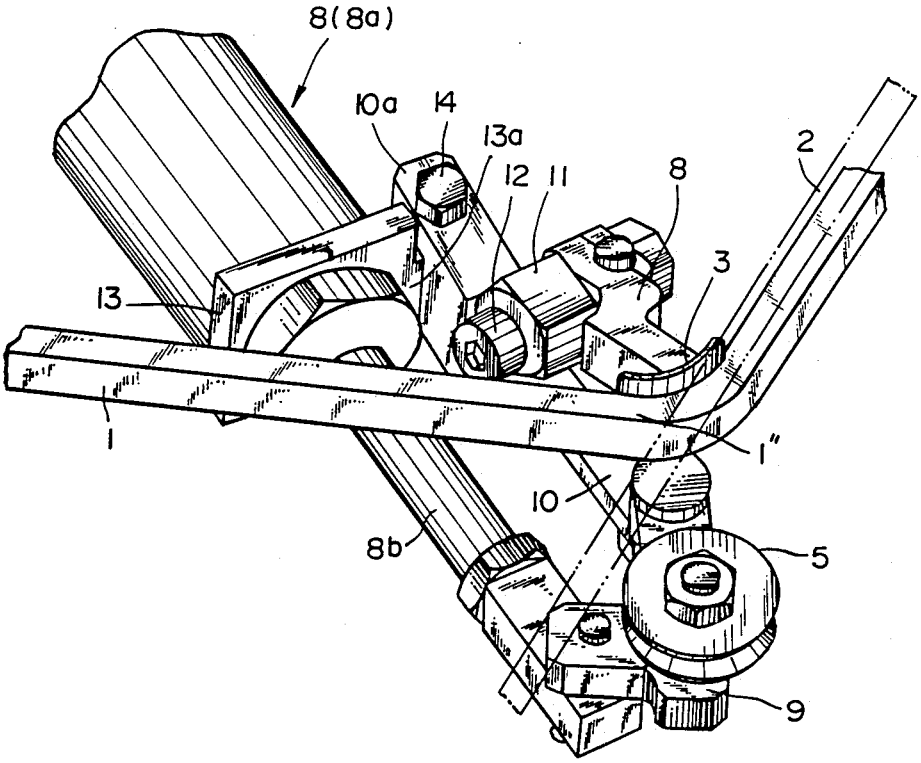
FIG. 6 is a fragmentary perspective view showing an embodiment of a bending machine according to the present invention.

That is, in the embodiment of FIGS. 6 through 8, one end of the lever 9 for moving the bending member 5 is pivoted to one end of a beam 10. The beam 10 has a forked piece 10*a* at its other end and a holding piece 11 attached integrally to its central portion. The holding piece 11 is rotatably connected via a support shaft 12 with a bracket 8*d* secured to the frame 1, and an air cylinder (not shown) is coupled to the beam 10. Accordingly, both ends of the beam 10 can swing vertically or it can rotate a certain angle, that is, the bending member 5 can shift a certain angle. Further, the other end of the lever 9 is pivoted to the piston rod 8*b* of the actuator 8 (the drawing shows the air cylinder 8*a* therefor), and an arm piece 13*a* connected directly with a collar portion 13 of the cylinder 8*a* is fitted to the forked piece 10*a* of the beam 10 and rotatably supported by a support shaft 14. Accordingly, upon the extension/retraction action of the piston rod 8*b*, the actuator 8 itself swings laterally to put the bending member 5 in a bendable state.

Specifically, as shown in FIGS. 7 and 8, the bending member 5 pivotable about the support shaft 12 is normally held in the (shifted-down) state A (FIG. 7(A)) so that the metallic conduit 2 cannot interfere with the bending member 5 even when it is moved or bent by the bending process of the preceding state. Then, when due to the bending process of the preceding stage the metallic conduit 2 comes into contact with the bending section of the stationary frame 1 (FIG. 7(B)), the bending member is shifted upward as shown in FIG. 7(B) and comes to the state C (FIG. 7(C)). Then, the piston rod 8*b* is retracted, so that the bending member changes from the state C to the (bending) state D (FIG. 7(D)) to perform bending. In this bending process, the actuator 8 mounted to the frame 1 swings laterally about the support shaft 14 as shown in FIG. 8 (from position C to D) so that the bending member 5 can bend the metallic conduit 2 so as to lie along the first guide surface 1′ or along the second guide surface 1″ and the guide member 3. After the completion of bending, the bending member 5 returns to the state E (FIG. 7(E)), that is, the actuator 8 swings rightward as shown in FIG. 8 (to position E). Then, the bending member is shifted downward and waits for a next bending process for another metallic conduit at position F (or in the state F of FIG. 7(F)).

It should be noted that the bending member is held in the state D until all bending stages are completed. Hence, each bending member serves as a pressing/positioning means with respect to each succeeding bending process, thereby enhancing the accuracy of the bending process.

On the other hand, in the embodiment of FIGS. 9 through 11, the bending member 5 is attached to the point of a piston rod 15*a* of a cylinder 15 separately provided, instead of being connected directly to the piston rod 8*b*. A collar portion 13 of the air cylinder 8*a* is secured to a bracket 7 attached to the stationary frame 1. In this case, the bending member 5 is normally retracted by the cylinder 15 so that the bending member 5 will not disturb the moving of the metallic conduit 2. That is, the air cylinder 8*a* is disposed while leaving a certain spacing with respect to the bend plane of the stationary frame 1. At the time of bending, the bending member 5 is projected by the cylinder 15 and moved to a predetermined position so as to lie along the frame 1 by the retraction action of the piston rod 8*b*.

Figure 10A:
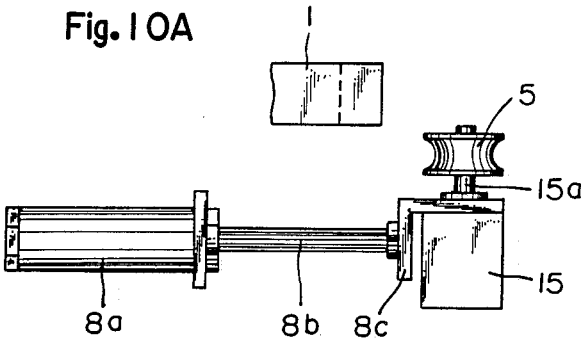
FIGS. 10(A) to 10(F) are front views explanatory of the operation of the embodiment shown in FIG. 9.
Figure 10D:
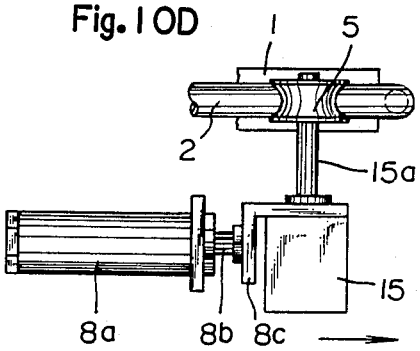
Figure 10B:
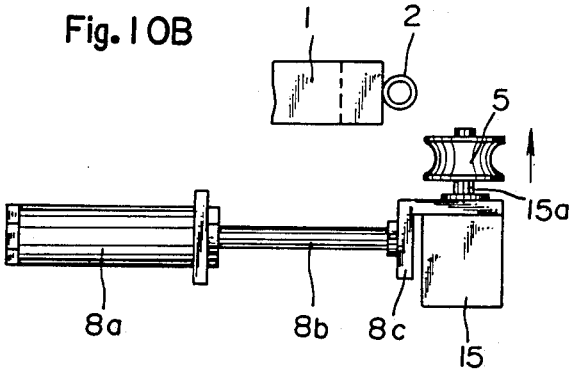
Figure 10E:
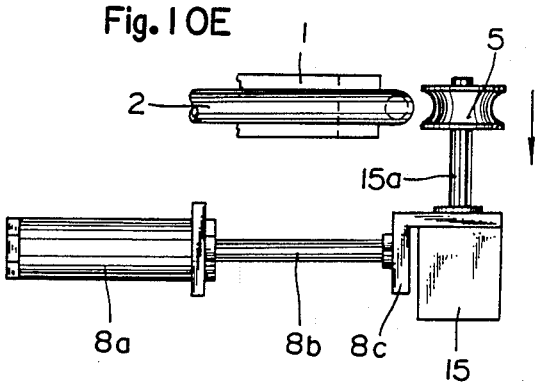
Figure 10C:
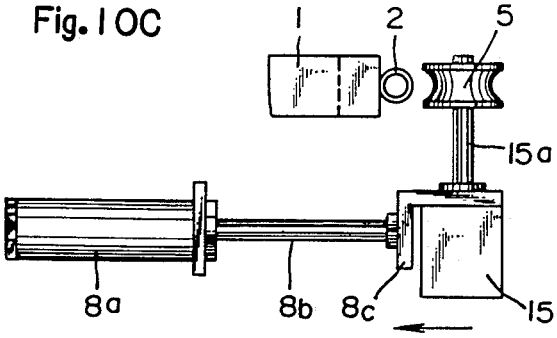
Figure 10F:
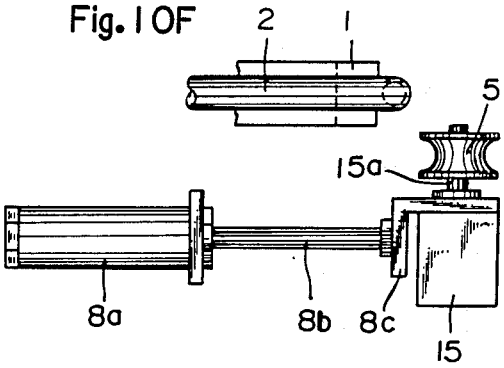
Figure 12:
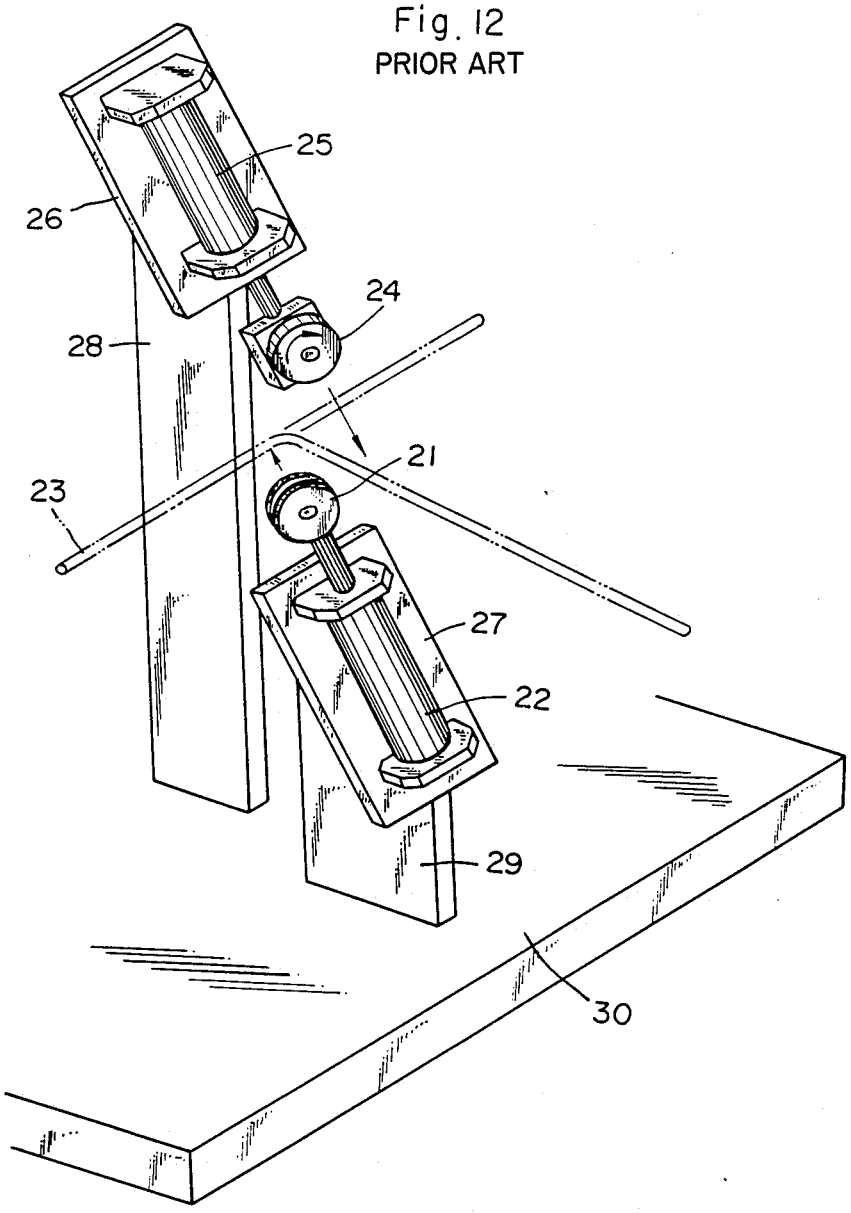
Fig. 12 PRIOR ART
FIG. 12 is a perspective view showing a conventional bending machine.

Specifically, as shown in FIGS. 10 and 11, the bending member 5 is normally held in the retracted state A (FIG. 10(A)) by means of the cylinder 15 so that the metallic conduit 2 cannot interfere with the bending member 5 even when it is bent by the bending process of a preceding stage. Then, when due to the bending process of the preceding stage the metallic conduit 2 comes into contact with the bending section of the stationary frame 1 as shown in FIG. 10(B), the cylinder 15 is actuated to extend and project the piston rod 15*a* to a predetermined position as shown in FIG. 10(C). Then, the piston rod 8*b* is retracted, so that the bending member changes from the state C to the (bending) state D (FIG. 10(D)) to perform bending. In this bending process, the bending member 5 bends the metallic conduit 2 so as to lie along the first guide surface 1′ or along the second guide surface 1″ and the guide member 3. Here, the cylinder 8*a*, which is attached to the frame 1 hereinabove, may be pivoted between the collar portion 13 and the bracket 7 so that the cylinder 8*a* can swing. Following the above, the bending member 5 is changed to the state E (FIG. 10 (E)) by the extension of the piston rod 8*b* and then is shifted downward to the state F (FIG. 10(F)) by the retraction of the piston rod 15*a*. In this state F, the metallic conduit completed through all bending processes is taken out and a next bending process for another metallic conduit is awaited.

It should be noted that if the bending member is held in the state D until all bending stages are completed, each bending member serves as a pressing/positioning means with respect to each succeeding bending process, thereby enhancing the accuracy of the bending process.

In performing the bending of the metallic conduit 2, first, one end of the straight metallic conduit 2 is locked and secured to a lock member 16 disposed at one end of the stationary frame 1 by means of an end fixture 17 as shown in FIG. 1 (a first mode), or a given point of an intermediate portion of the conduit that is indexed using a stopper or the like (not shown) is secured by a clamp tool (not shown) or the like (a second mode). Then, the bending process is carried out, from the secured end side toward the free end side in the first mode, or from the secured portion toward both free ends in the second mode, by progressively causing the straight or circular movement of the bending member 5 toward the frame 1 so that the metallic conduit 2 can be pressed so as to lie along the first guide surface 1′ or along the second guide surface 1″ and the guide member 3 of the frame 1. Of course, the machine of the present invention can be used in bending not only metallic conduit, but also bar stock. Although the actuator made of the air cylinder is illustrated in the drawing, a rotary actuator (not shown) may be used.

As described above in greater detail, according to the present invention, the bending process is carried out by means of the stationary frame 1 and the bending member 5 which is moved from outside the guide member 3 by the actuator 8 attached to the frame 1 directly or via the post 4 or bracket so that the metallic conduit 2 can be bent so as to lie along the guide member 3 and the first guide surface 1′ or second guide surface 1″. Therefore, since the actuator 8 for moving the bending member 5 is coupled to the stationary frame 1, flexure is prevented from appearing in the stay or the like. Further, since the bending member 5 is actuated preferably when the actuator 8 is pulling its piston rod, the influence of looseness of a bush provided for the piston rod that becomes worse when the piston rod is pushing or in an extended state is reduced to a minimum, in contrast to the prior art, and it is possible to nearly prevent the imposition of the bending moment. Therefore, it is possible to prevent any minute discrepancy (breathing) from appearing between the bending member 5 and the guide member 3, thus to fabricate curved products of high preciseness.

Because the machine is configured to enable the bending member to be shifted or retracted and then, at the time of bending, returned or projected to a predetermined position, the bending units can be disposed close to each other, the setting of these units can be achieved without using any complicated mechanism, and the individual bending processes can be contiguously performed without troubles. Additionally the finished metallic conduit can be readily taken out of the machine by retracting the bending members after the completion of bending. Further, the whole bending machine is composed simply by cutting a square bar or the like on the market to given lengths, bending, and welding together into a continuous shape so as to substantially conform to the finished curved shape of the metallic conduit over the whole length, by providing the plate-like guide members 3 at given positions to complete the frame 1, and by disposing the bending members 5 (inclusive of the actuators 8) so that they can move toward the frame. Accordingly, as compared with the prior art, the number of parts is remarkably decreased; hence, the machine can be made small in size, light in weight, and low in cost. Further, since the machine can be manufactured in a very short time, it can be surely put in serviceable state before the start of mass production.

What is claimed is:

1. A small-diameter metallic conduit bending machine for bending small-diameter metallic conduit into a finished curved shape, said shape of said conduit including at least first and second curves defining at least first and second bend planes respectively, said bend planes being angularly aligned to one another, said bending machine comprising:

a stationary frame which is formed by connecting bar stock or pipe stock into a shape substantially conforming to the finished curved shape of the metallic conduit over the whole length, at least first and second bending sections provided in said stationary frame, said first bending section including an elongated first guide surface having a curvature smaller than the bend radius of the first curve of the metallic conduit in the lengthwise direction of the guide surface and being substantially orthogonal to the first bend plane of the metallic conduit in the widthwise direction, and said second bending section including a second guide surface which is substantially planar and substantially parallel to the second bend plane, said second bending section further including a guide member which is mounted to said stationary frame in a direction substantially orthogonal to said second guide surface and has a curvature smaller than the bend radius of the second curve of the metallic conduit, a bending member which is moved by a actuator attached to said stationary frame and is selectively movable in a direction generally parallel to a selected one of said bend planes toward said stationary frame in a bending position for bending the metallic conduit to lie along a selected one of said first guide surface in said first bending section and said guide member in said second bending section, and removing means for removing said bending member in a direction angularly aligned to the selected bend plane into a nonbending position away from said bending position when said bending member is to interfere with the metallic conduit which is moving as the result of the bending process at another one of said bending sections.

2. A small-diameter metallic conduit bending machine according to claim 1, wherein said removing means comprises rotating means for rotating said bending member away from the selected bend plane, said rotating means being pivoted to said stationary frame via a bracket for pivoting movement through a selected angle.

3. A small-diameter metallic conduit bending machine according to claim 1, wherein said removing means comprises an actuator which is spaced from the selected bend plane of said stationary frame and is operative to selectively extend said bending member toward and away from the selected bend plane.

4. A small-diameter metallic conduit bending machine according to claim 1, wherein said stationary frame is composed by welding bar stock or pipe stock.

5. A small-diameter metallic conduit bending machine according to claim 1, wherein said guide member provided in said second bending section is shaped like a plate piece or a block.

6. A small-diameter metallic conduit bending machine according to claim 1 wherein said removing means is operative to move said bending member in a direction generally orthogonal to the selected bend plane.

7. A small-diameter metallic conduit bending machine for bending a small-diameter metallic conduit into a finished curved shape including a plurality of curves, each said curve defining a bend plane, said bending machine comprising:

a frame comprising a plurality of elongated curved surfaces disposed generally in end-to-end alignment and in selected spaced relationship to one another to substantially conform to the finished curved shape of the metallic conduit over the whole length of the metallic conduit, each said curved surface defining a widthwise direction extending substantially orthogonal to a corresponding one of said bend planes of said conduit;

a plurality of bending members disposed in a bending position in proximity to at least selected ones of the curved surfaces of said frame, said bending members is said bending position being selectively and sequentially movable generally in the respective bend planes of the curved surfaces for bending the metallic conduit against the respective curved surfaces;

a plurality of bend actuators for selectively and sequentially moving the respective bend members in the respective bend planes toward and away from the corresponding curved surfaces of the frame to bend said metallic conduit; and removing means for selectively moving at least one of said bending members in a direction angularly aligned to the respective bending plane into a nonbending position away from said bending position for preventing said bending member from interfering with the metallic conduit being bent by another of said bending members.

8. A bending machine as in claim 7 wherein the bend actuator comprises a piston/cylinder assembly extending between said frame and said bending member.

9. A bending machine as in claim 8 wherein the removing means is mounted to the piston/cylinder assembly and comprises means for moving the bending member in a direction orthogonal to the bend plane.

10. A bending machine as in claim 9 wherein the piston/cylinder assembly defining the bend actuators is a first piston/cylinder assembly, and wherein the removing means comprises a second piston/cylinder assembly mounted to the first piston/cylinder assembly for moving the bending member in a direction extending generally orthogonal to the respective bend plane.

11. A bending machine as in claim 7 wherein the removing means comprises means for pivoting the bend member away from the bend plane.

12. A bending machine as in claim 7 wherein a plurality of said bend planes are angularly aligned to one another.

* * * * *